US009089173B2

(12) United States Patent
Krishnan

(10) Patent No.: US 9,089,173 B2
(45) Date of Patent: Jul. 28, 2015

(54) PANTS AND SIMILAR TYPES WITH A CONVENIENT FLAP

(71) Applicant: Vinu B. Krishnan, Pittsburg, KS (US)

(72) Inventor: Vinu B. Krishnan, Pittsburg, KS (US)

( * ) Notice: Subject to any disclaimer, the term of this patent is extended or adjusted under 35 U.S.C. 154(b) by 0 days.

(21) Appl. No.: 14/511,418

(22) Filed: Oct. 10, 2014

(65) Prior Publication Data

US 2015/0135407 A1 May 21, 2015

Related U.S. Application Data

(60) Provisional application No. 61/905,207, filed on Nov. 17, 2013.

(51) Int. Cl.
*A41D 13/02* (2006.01)
*A41D 1/06* (2006.01)
*A41F 9/00* (2006.01)

(52) U.S. Cl.
CPC .... *A41D 1/06* (2013.01); *A41F 9/00* (2013.01)

(58) Field of Classification Search
CPC ..... A41D 13/02; A41D 13/00; A41D 9/08; A41D 1/06; A41D 1/08; A41D 9/04
USPC ..... 2/79, 80, 78.2, 83, 227, 228, 238, 234, 2/408
See application file for complete search history.

(56) References Cited

U.S. PATENT DOCUMENTS 1,469,287 A * 10/1923 Torchia ..... 2/408
3,208,454 A * 9/1965 Farkas ..... 450/103
3,279,469 A * 10/1966 Schustack ..... 450/113
4,961,234 A * 10/1990 Leibman ..... 2/234
5,341,515 A * 8/1994 Cohen ..... 2/400
5,636,387 A * 6/1997 Lundy ..... 2/408
5,822,793 A * 10/1998 Tokura et al. ..... 2/69
5,896,581 A 4/1999 Wong
6,192,522 B1 2/2001 Schreib
6,243,878 B1 6/2001 Khemka
6,477,711 B1 11/2002 Freeman
6,477,716 B2 11/2002 Blaire
D505,535 S 5/2005 Kern
6,928,661 B2 8/2005 Lewis (Continued)

OTHER PUBLICATIONS

EZ-GO Pants, EZ-GO Shorts, retrieved from http://ezgopants.com/products/shorts-2/ . . . , 2014, 2 pages.

(Continued)

*Primary Examiner* — Tejash Patel
(74) *Attorney, Agent, or Firm* — Brian S. Steinberger; Law Offices of Brian S. Steinberger, P.A.

(57) ABSTRACT

Bifurcated leggings such as pants, jeans, trousers, shorts, leggings or pajamas with front flap for providing a convenient access to a front opening of underwear/panties for using a toilet, changing sanitary napkins, performing sexual intercourse, or allow minimally invasive surgical treatment, in the pelvic/vaginal region, without completely removing or pulling down the legged clothing. A front flap extending beyond the crotch area can have fasteners to secure the flap on the sides and plural front buttons to tie the flap on the top. Alternatively, fasteners can be provided to secure the flap from behind, when using the toilet. The flap can be an integral cloth, hinged or attached on the posterior of the pants, and can be Y-shaped or an hourglass shaped and opens in the front. A zipper, zip, fly or zip fastener can bind edges of the fabric opening, based on interlocking teeth.

18 Claims, 4 Drawing Sheets

(56) References Cited

U.S. PATENT DOCUMENTS

| | | | |
|---|---|---|---|
| 7,032,249 | B2 | 4/2006 | Smith |
| 7,100,214 | B1 | 9/2006 | Murray |
| D550,428 | S | 9/2007 | Kern |
| 7,966,672 | B1 | 6/2011 | Hagerman |
| 8,479,320 | B2 | 7/2013 | Swafford |
| 2012/0060264 | A1 | 3/2012 | Wilkins |
| 2012/0167271 | A1 | 7/2012 | Swafford |

OTHER PUBLICATIONS

Josie Front Opening Panty, retrieved from http://www.livingmadeeasy.org.uk/toileting/side-and-crotch-fastening-p . . . , 2014, 1 page.

Titan Clothing, Josie Front Opening Panty—Full Brief, retrieved from http://www.underwearfordisabled.co.uk/products/Josie-Front-Opening . . . , 2014, 3 pages.

Pajamas, retrieved from http://en.wikipedia.org/wiki/Pajamas . . . ,2014, 7 pages.

Trousers, retrieved from http://en.wikipedia.org/wiki/Trousers . . . , 2014, 12 pages.

Drop Seat Pajamas, retrieved from http://www.wisegeek.com/what-are-drop-seat-pajamas.htm . . . , 2014, 5 pages.

History of Trousers, Why We Wear Pants, retrieved from http://www.livescience.com/34077-wearing-pants-horse-riding.html . . . , 2012, 7 pages.

* cited by examiner

PANTS AND SIMILAR TYPES WITH A CONVENIENT FLAP

This application claims the benefit of priority to U.S. Provisional Application Ser. No. 61/905,207 filed Nov. 17, 2013, the entire disclosure of which is incorporated herein by specific reference thereto.

FIELD OF INVENTION

This invention relates to bifurcated legged clothing, and in particular to garments, pants, jeans, trousers, shorts, leggings or pajamas (pajamas), with a convenient front flap for providing a convenient front flap to help the user in conjunction with front opening (or easy access or open crotch) underwear/panties in using a toilet, changing sanitary napkins (menstrual pad or tampons) or performing sexual intercourse, without having to remove or pull down the legged clothing completely, as well as to allow others to perform minimally invasive surgical treatment, in the pelvic/vaginal region, without removing or pulling down the legged clothing completely.

BACKGROUND AND PRIOR ART

Bifurcated legged clothing, in one form or another, have been in use for centuries. Typically, bifurcated legged clothing are comprised of pants, trousers, jeans, shorts, leggings and pajamas. These are outer garments worn by men and women that covers the body from the waist (or hip) downwards, covering each leg separately (rather than a cloth across both legs as in skirts and other dresses), usually as far as the ankles. Technically, any bifurcated legged garment or clothing worn on the lower torso will be a prior art.

Other commonly used synonyms for pants include pantaloons, breeches, britches, slacks, baggies, bell-bottoms, blue jeans, cargo pants, cords, corduroys, denims, hose, legging (or leggin), sweatpants, pants suit, pantsuit, bloomers, knee breeches and knickerbockers. Other bifurcated legged clothing can include "Neck to Toe" suits, such as workshop garments, space suits or nightwear garments.

A main problem with conventional bifurcated legged clothing is that one has to pull them down when using a toilet, especially for the women. Most pants have a fly, an opening covering the groin that makes the pants easier to put on or take off. The opening also allows men to urinate without lowering their pants, but not for women.

There have been some modifications in pants (in general) throughout the history, which are not as effective as the current invention. For example, some pajamas feature a drop seat (also known as a trap door or butt flap), a buttoned opening in the back, designed to allow the wearer to conveniently use a toilet.

However, these types of clothing have drawbacks that makes it difficult to wear underwear. Drop seats were very common on pajamas made prior to 1950s, but today they are rather rare.

A brand named "EZ-GO™ PANTS/SHORTS" was launched to serve anyone (typically men) who is infirmed, confined to a bed or in a wheelchair, in elderly care or rehabilitation.

Another problem with conventional bifurcated legged clothing for women is that they are not able to change sanitary napkins (menstrual pad or tampons) without pulling down the pants, in a limited privacy.

Another problem with conventional bifurcated legged clothing for women is that they are not able to be worn when performing sexual intercourse without removing or pulling down the pants completely.

Additionally, typical pants hinders doctors to perform minimally invasive surgical treatment, in the pelvic/vaginal region. The above is also quite inconvenient for people in uniforms such as athletes, pilots, truck drivers, etc., as well as hospital patients, disabled persons, and the elderly.

While these different types of prior art may be suitable for the particular purpose to which they address, they are not as suitable for providing a convenient flap in the front of the pants and similar types such as, but not restricted to jeans, trousers, shorts, leggings or pajamas. This would help the user in conjunction with front opening (or easy access or open crotch) underwear/panties in using a toilet, changing sanitary napkins (menstrual pad or tampons) or performing sexual intercourse, without removing or pulling down the pants completely.

Most pants have a fly, an opening covering the groin that makes the pants easier to put on or take off. The opening also allows men to urinate without lowering their pants, but not for women. There had been some modifications in pants (in general) throughout the history, which are not as effective as the current invention.

In these respects, the pants and similar types with a convenient front flap according to the present invention substantially departs from the conventional concepts and designs of the prior art, and in so doing provides a contraption primarily developed for the purpose of providing a convenient flap in the front of the pants and similar types such as, but not restricted to jeans, trousers, shorts, leggings or pajamas. This would help the user in conjunction with front opening (or easy access or open crotch) underwear/panties in using a toilet, changing sanitary napkins (menstrual pad or tampons) or performing sexual intercourse, without removing or pulling down the pants completely. Additionally, the invention will allow performing minimally invasive surgical treatment, in the pelvic/vaginal region, without removing or pulling down the pants completely.

Thus, the need exists for solutions to the above problems with the prior art.

SUMMARY OF THE INVENTION

A primary objective of the invention is to provide bifurcated legged clothing, such as pants, jeans, trousers, shorts, leggings or pajamas (pajamas), with a convenient front flap for providing a convenient front opening (or easy access or open crotch) for using a toilet without removing or pulling down the legged clothing completely.

A secondary objective of the invention is to provide bifurcated legged clothing, such as pants, jeans, trousers, shorts, leggings or pajamas (pajamas), with a convenient front flap for providing a convenient front opening (or easy access or open crotch) for changing or inserting sanitary napkins (menstrual pad or tampons) without removing or pulling down the legged clothing completely.

A third objective of the invention is to provide bifurcated legged clothing, such as pants, jeans, trousers, shorts, leggings or pajamas (pajamas), with a convenient front flap for providing a convenient front opening (or easy access or open crotch) for performing sexual intercourse, without having to remove or pull down the legged clothing completely.

A fourth objective of the invention is to provide bifurcated legged clothing, such as pants, jeans, trousers, shorts, leggings or pajamas (pajamas), with a convenient front flap for providing a convenient front opening (or easy access or open crotch) for allowing health professionals to perform minimally invasive surgical treatment, in the pelvic/vaginal region on a woman, without having to remove or pull down the legged clothing completely.

The invention includes a front flap that typically extends beyond the crotch area, dual zippers or alternatives to secure the flap on the sides and two (or multiple) front buttons or alternatives to tie the flap on the top.

Additionally, two back buttons or alternatives can be provided to secure the flap from behind, when using the toilet. The flap is an integral cloth, hinged or attached at the posterior of the pants. It can be a generally Y-shaped (like the crotch portion of a thong) or an hourglass shaped cloth and opens from the front. A zipper, zip, fly or zip fastener (formerly known as a clasp locker) can be used for binding the edges of a fabric opening, based on the mechanism of interlocking teeth. A button or a small fastener, most made of plastic or metal can secure two pieces of fabric together. Additionally, it can be made of any alternative natural or artificial material used in the garment industry.

Further objects and advantages of this invention will be apparent from the following detailed description of the presently preferred embodiments which are illustrated schematically in the accompanying drawings.

BRIEF DESCRIPTION OF THE FIGURES

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figures 1A, 1B:
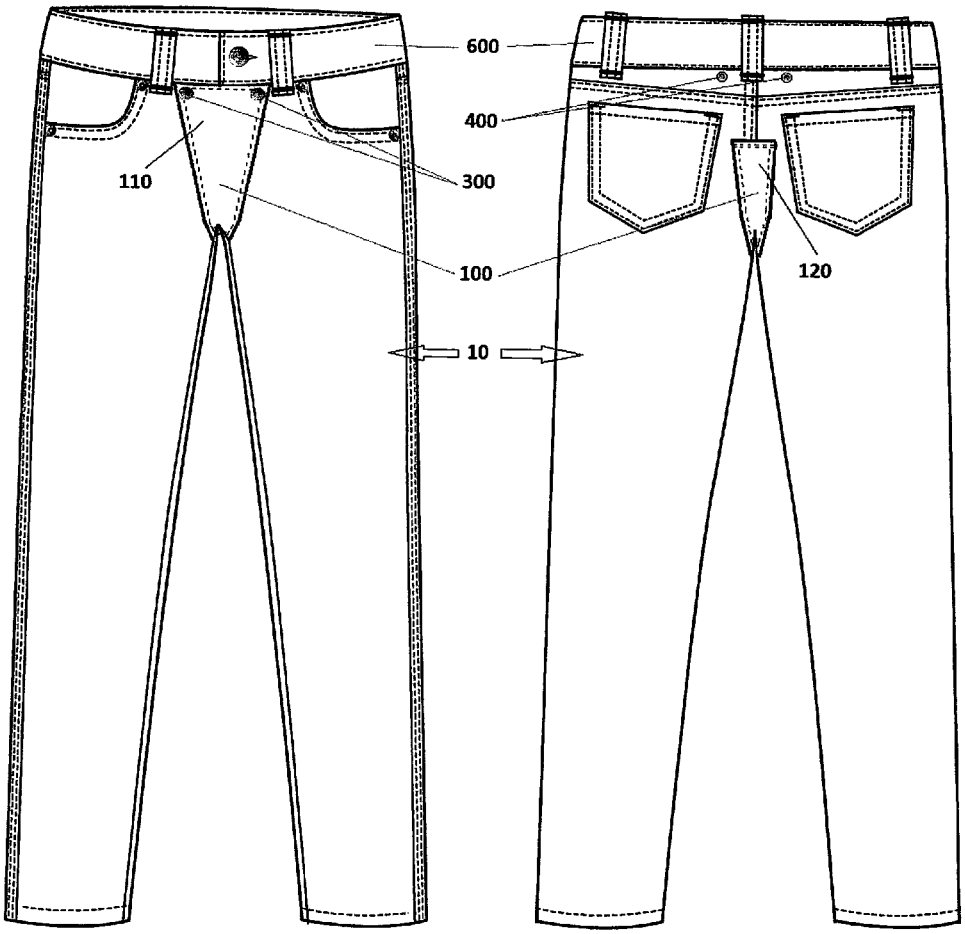
FIG. 1A is a front view of a first embodiment bifurcated legging with flap closed.
FIG. 1B is a rear view of the first embodiment of FIG. 1A with the flap closed.
Figures 2A, 2B:
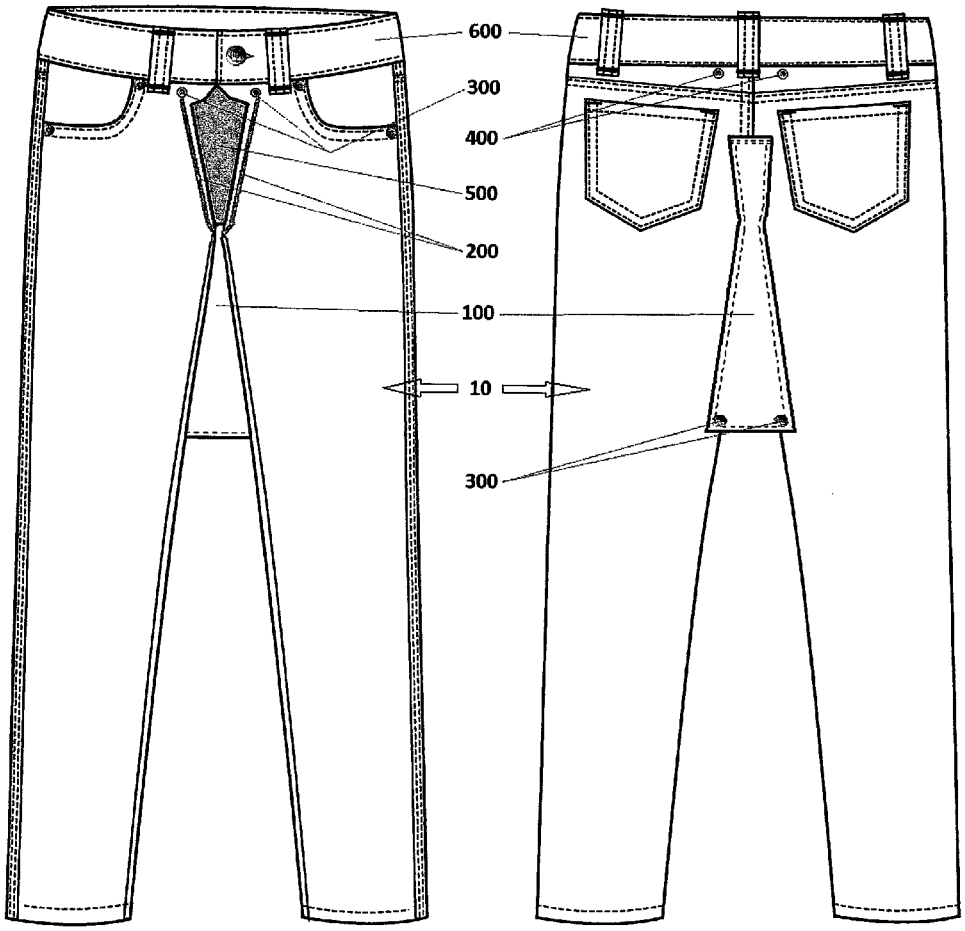
FIG. 2A is a front view of the first embodiment of FIG. 1A with the flap opened.
FIG. 2B is a rear view of the first embodiment of FIG. 1A with the flap opened.

10 first embodiment bifurcated leggings
20 second embodiment bifurcated leggings
100 flap (first embodiment)
100B flap (second embodiment)
110 front flap portion
120 rear flap portion
200 side fasteners such as dual zippers
300 front fasteners such as buttons
400 back fasteners such as buttons
500 opening in pants(crotch area)
600 waistband FIG. 1A is a front view of a first embodiment of bifurcated legged clothing 10, with the flap 100 closed. FIG. 1B is a rear view of the first embodiment of FIG. 1A with the flap 100 closed. FIG. 2A is a front view of the first embodiment of FIG. 1A with the flap 100 opened. FIG. 2B is a rear view of the first embodiment of FIG. 1A with the flap 100 opened.

Referring to FIGS. 1A-2B, bifurcated leggings 10 such as but not limited to pants, jeans, trousers, shorts, leggings or pajamas have a flap 100 that can have a Y shape similar to the crotch portion of a thong, or hour glass shape. Flap 100 can include a front generally triangular portion 110, and a smaller rear smaller triangular portion 120. The front flap portion 110 can extend beyond the crotch area, with fasteners 200 such as but not limited to dual zippers or alternatives to secure the front flap portion 110 on the sides and plural front fasteners 300 such as buttons or alternatives to tie the top flap portion 110 on the top.

Alternatively, back fasteners 400 such as but not limited to two back buttons or alternatives can be provided to secure the rear flap portion 120 from behind, when using the toilet. The flap 100 an integral cloth, hinged or attached at the posterior of the pants. It is generally a Y-shaped (like the crotch portion of a thong) or an hourglass shaped cloth and opens from the front. Fasteners 200 can include at least one of a zipper, zip, fly or zip fastener (formerly known as a clasp locker) is a commonly used device for binding the edges of a fabric opening, based on the mechanism of interlocking teeth. Each of the fasteners 400 can include a button such as a small fastener, most commonly made of plastic or metal that secures two pieces of fabric together. Additionally, it can be made of any alternative natural or artificial material used in the garment industry.

Flap 100 can include an integral cloth, hinged or attached at the posterior of the bifurcated leggings. Flap 100 can be a piece of clothing that starts from or below waistband 600 (or trouser support) and extends beyond the crotch area of the bifurcated leggings and can be hinged or attached to the pants at the posterior. Compared to the prior arts, such as in an opening or a fly, the flap 100 can go all the way up to the posterior or the buttocks, covering the entire crotch portion. Flap 100 can cover a similar opening 500 in the bifurcated leggings, when the fasteners 200 such as the dual zippers are closed. It hangs down when the fasteners 200 such as the dual zippers and front 300 such as buttons are opened.

Although the embodiment in the drawings show a Y or hourglass shape in construction, other possible geometric shapes can be, but not restricted to rectangular or near rectangular or triangular or oval or oblong pieces of cloth and material can be used. Additionally, the seam(s) can be straight, zigzag or any other possible seam used in the garment industry.

A zipper, zip, fly or zip fastener (formerly known as a clasp locker) is a commonly used device for binding the edges of a fabric opening, based on the mechanism of interlocking teeth. Fasteners 200 such as but not limited dual zippers can be used for binding the sides of the front flap with corresponding edges on the pants. In FIGS. 1A-2B, side fasteners 200 such as dual zippers can start from or below waistband 600 and extends all the way up to the posterior or the buttocks where the end of the flap 100 is attached, covering the entire crotch portion. Alternatively, the front flap 100 can be entirely secured by hook and loop fastener (such as VELCRO®) or any other fastener used in the garment industry.

Small fasteners 300 such as but not limited to button(s) can be used as a small fastener, most commonly made of plastic or metal that secures two pieces of fabric together. Additionally, it can be made of any alternative natural or artificial material used in the garment industry. The front 300 such as the buttons can secures the front portion 110 of the flap 100 at the top edge, with the bifurcated leggings. Front fasteners 300 can include two buttons. However, it should be understood that a single or multiple fasteners, such as single or plural buttons can perform the same function. The front fasteners, such as the buttons can protect against any accidental opening of the side fasteners 200 such as dual zippers. Alternatively, the front fasteners 300 such as the buttons can be replaced by hook and loop fastener or snap fasteners or any other fastener used in the garment industry.

A button is a small fastener, most commonly made of plastic or metal that secures two pieces of fabric together. Additionally, it can be made of any alternative natural or artificial material used in the garment industry. Back buttons 400 are optional features provided at the posterior of the pants to hold the flap in an open position. Typically, two buttons are preferred. However, it should be understood that a single or multiple buttons can perform the same function. Alternatively, the back buttons 400 can be replaced by hook and loop fastener or snap fasteners or any other fastener used in the garment industry.

Figures 3A, 3B:
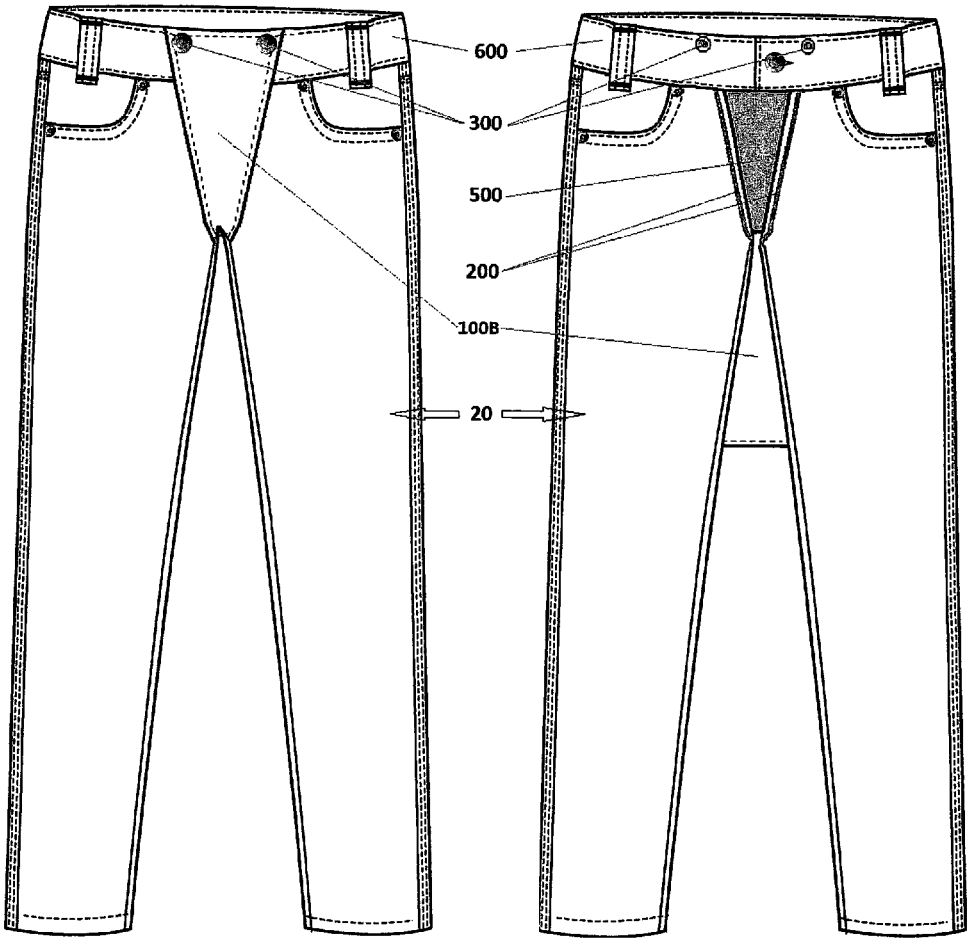
FIG. 3A is a front view of another embodiment bifurcated leggings with flap closed.
FIG. 3B is a front view of the embodiment of FIG. 3A with flap opened.
Figures 4A, 4B:
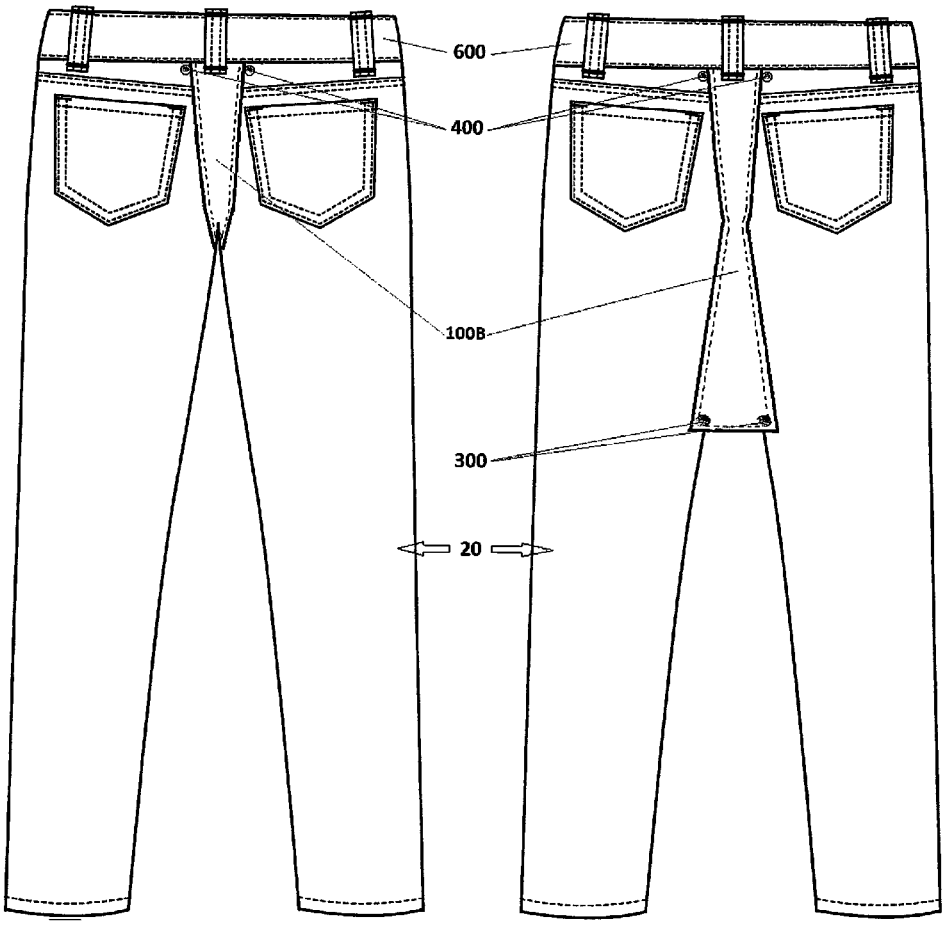
FIG. 4A is a rear view of the embodiment of FIG. 3A with flap closed.
FIG. 4B is a rear view of embodiment of FIG. 3B with flap opened.

FIG. 3A is a front view of another embodiment of bifurcated legged clothing 20 with the flap 100B closed. FIG. 3B is a front view of the embodiment of FIG. 3A with flap 100B opened. FIG. 4 is a rear view of the embodiment of FIG. 3A with flap 100B closed. FIG. 4B is a rear view of embodiment of FIG. 3B with flap 100B opened.

Referring to FIGS. 3A-4B, the flap 100B can start above the crotch region and be above the waistband. The fasteners 200 such as but not limited to dual zippers help bind the flap 100B with corresponding edges on the bifurcated leggings. That is, the fasteners 200 such as dual zippers can help secure the flap 100B on the sides. On the top, the front flap can be secured to the bifurcated leggings above the waistband 600 using front fasteners 300, such as but not limited to buttons. Similarly, two optional back fasteners 400 such as but not limited to buttons can be provided to secure the flap 100B from behind, for example, when using the toilet.

Depending on the type of bifurcated leggings, such as pants used in the fashion industry, such as waist, hip or low cut, the position on the pants to which the top portion of front portion 110 of the flap 100B attaches can vary. That is, the top portion of front portion of the flap 100B can attach above or on or below the waistband 600 (the circular band around the waist/hip). Additionally, the present invention is not restricted/biased to any gender or age. Even though the present invention suites women better, it provides equal access and convenience to men and elderly persons.

In another embodiment of the invention, the interior of the flap 100/100B can be affixed with a detachable inner lining for use with panty alternatives or for securing sanitary napkins by women users.

In multiple embodiments, the disclosed invention, with minor variations, is used with a variety of bifurcated legged clothing including trousers, shorts, leggings, and jeans, "Neck to Toe" suits, such as workshop garments, space suits or nightwear garments.

Referring to FIGS. 1A-4B, the incorporation of flap 100/100B on the bifurcated leggings 10, 20 such as on pants can allow the user to use a toilet (in conjunction with front opening or easy access or open crotch underwear/panties), without pulling down the pants. To open the front portion 110 of flap 100/100B, the user has to untie the front fasteners 300, such as the front buttons, followed by opening of the side fasteners 200 such as the dual zippers. The optional back fasteners 400 such as back buttons provided at the posterior of the bifurcated leggings such as the pants can hold the flap 100/100B in an open position, without holding it by hands or other means, when using the toilet. To close the flap 100/100B, the user has to remove or untie the flap 100/100B from the back fasteners (buttons) 400 (optional), then closing of the side fasteners 200 such as dual zippers and followed by securing of the front fasteners (buttons) 300.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A bifurcated legged outer garment comprising:

a waistband having a front side with a plurality of belt loops and a rear side with a plurality of belt loops;

a pair of leg portions extending downwardly from the waistband; and a flap positioned having a front portion with an upper front end attached by an upper front fastener adjacent to the waistband and covering an opening in the front crotch area of the bifurcated legged outer garment, the flap having a rear portion extending beyond the crotch area and an upper rear end being attached to a posterior portion of the bifurcated legged outer garment adjacent to the waistband.

2. The bifurcated legged garment of claim 1, wherein the upper front fastener is selected from buttons and snaps, and hook and loop fasteners.

3. The bifurcated legged outer garment of claim 1, further comprising:

a pair of elongated front side flap binding fasteners each aligned along right and left front sides of the front portion of the flap for binding the front portion of the flap to the pair of leg portions.

4. The bifurcated legged outer garment of claim 3, wherein the pair of elongated front side flap binding fasteners are selected from zippers and hook and loop fasteners.

5. The bifurcated legged outer garment of claim 1, further comprising:

upper rear removable fasteners for attaching and detaching the upper rear end of the rear portion of the flap from the leg portions, the rear removable fasteners selected from buttons, snaps and hook and loop fasteners.

6. The bifurcated legged outer garment of claim 1, wherein the flap includes:

a Y shape.

7. The bifurcated legged outer garment of claim 1, wherein the flap includes:

an hourglass shape.

8. The bifurcated legged outer garment of claim 1, wherein the flap includes:

a rectangular shape.

9. The bifurcated legged outer garment of claim 1, wherein the flap includes:

a triangular shape.

10. The bifurcated legged outer garment of claim 1, wherein the flap includes:

an oblong shape.

11. The bifurcated legged outer garment of claim 1, wherein the flap includes:

an oval shape.

12. The bifurcated legged outer garment of claim 1, wherein the upper front fastener attaches the front portion of the flap to the bifurcated legged outer garment below the waistband.

13. The bifurcated legged outer garment of claim 1, wherein the upper front fastener attaches the front portion of the flap to the bifurcated legged outer garment at the waistband.

14. The bifurcated legged outer garment of claim 1, wherein the upper front fastener attaches the front portion of the flap to the bifurcated legged outer garment above the waistband.

15. The bifurcated legged outer garment of claim 1, further comprising:

a detachable liner affixed to an interior surface of the flap coinciding with the side of the flap, the detachable liner being used as a panty or sanitary napkin.

16. The bifurcated legged outer garment of claim 1, wherein the plurality of belt loops on the rear side of the waistband includes:

a rear middle belt loop midway along the rear side of the waistband, the rear middle belt loop being midway along the upper rear end of the rear portion of the flap.

17. The bifurcated legged outer garment of claim 16, wherein the plurality of belt loops on the front side of the waistband includes:

a pair of front belt loops, each being to a left and to a right of the upper front end of the front portion of the flap.

18. The bifurcated legged outer garment of claim 1, wherein the plurality of belt loops on the front side of the waistband includes:

a pair of front belt loops, each being to a left and to a right of the upper front end of the front portion of the flap.

* * * * *